US007089993B2

(12) United States Patent
Wyatt-Mair et al.

(10) Patent No.: US 7,089,993 B2
(45) **Date of Patent: *Aug. 15, 2006**

(54) METHOD AND APPARATUS FOR CONTINUOUS CASTING

(75) Inventors: Gavin F. Wyatt-Mair, Lafayette, CA (US); Ali Unal, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/078,631

(22) Filed: Mar. 11, 2005

(65) Prior Publication Data

US 2005/0205234 A1 Sep. 22, 2005

Related U.S. Application Data

(63) Continuation-in-part of application No. 10/377,376, filed on Feb. 28, 2003, now Pat. No. 6,880,617.

(51) Int. Cl.
*B22D 11/06* (2006.01)

(52) U.S. Cl. ..... 164/479; 164/429; 164/432; 164/481

(58) Field of Classification Search ..... 164/429–432, 164/479, 481
See application file for complete search history.

(56) References Cited

U.S. PATENT DOCUMENTS

| | | | | |
|---|---|---|---|---|
| 3,848,658 | A | 11/1974 | Hazelett et al. | 164/278 |
| 3,937,270 | A | 2/1976 | Hazelett et al. | 164/50 |
| 4,002,197 | A | 1/1977 | Hazelett et al. | 164/250 |
| 4,632,176 | A | 12/1986 | Pearce | 164/481 |
| 5,515,908 | A | 5/1996 | Harrington | 164/481 |
| 5,564,491 | A | 10/1996 | Harrington | 164/481 |
| 5,894,879 | A | 4/1999 | Wyatt-Mair et al. | 164/476 |
| 6,044,896 | A | 4/2000 | Harrington | 164/428 |
| 6,102,102 | A | 8/2000 | Harrington | 164/481 |
| 6,135,199 | A | 10/2000 | Wyatt-Mair | 164/481 |
| 6,173,755 | B1 | 1/2001 | Li et al. | 164/429 |

FOREIGN PATENT DOCUMENTS

| | | |
|---|---|---|
| JP | 54152628 A | 12/1979 |
| JP | 62057746 A | 3/1987 |
| JP | 01313157 A | 12/1989 |
| WO | WO 02/066181 | 8/2002 |

*Primary Examiner*—Kuang Y. Lin
(74) *Attorney, Agent, or Firm*—Greenberg Traurig LLP; Harry A. Hild, Jr.

(57) ABSTRACT

A method and apparatus for continuous casting of metal strip, the apparatus having (i) a first endless belt supported and moved on the surfaces of a first entry pulley and a first exit pulley and (ii) a second endless belt supported and moved on the surfaces of a second entry pulley and a second exit pulley, with an entry nip defined between the first and second entry pulleys and an exit nip defined between the first and second exit pulleys. Opposing surfaces of the first and second belts progressively diverge from each other in the direction of movement thereof. The apparatus may include a cooled roll in place of the first pulley and first belt with a nip defined between the cooled roll and the second entry pulley.

18 Claims, 5 Drawing Sheets

METHOD AND APPARATUS FOR CONTINUOUS CASTING

CROSS REFERENCE TO RELATED APPLICATIONS

This continuation-in-part application claims the benefit under 35 U.S.C. 120 of U.S. patent application Ser. No. 10/377,376, now U.S. Pat. No. 6,880,617 filed on Feb. 28, 2003, the disclosure of which is fully incorporated by reference herein.

FIELD OF THE INVENTION

The present invention relates to continuous casting of metals, such as aluminum alloys, more particularly, to continuous casting using at least one belt.

BACKGROUND OF THE INVENTION

Continuous casting of metals such as aluminum alloys has been performed in continuous casters, such as twin roll casters and belt casters. Twin roll casting traditionally is a combined solidification and deformation technique involving feeding molten metal into the bite between a pair of counter-rotating cooled rolls wherein solidification is initiated when the molten metal contacts the rolls. Solidified metal forms as a "freeze front" of the molten metal within the roll bite and solid metal advances towards the nip, the point of minimum clearance between the rolls. The solid metal passes through the nip as a solid sheet. The solid sheet is deformed by the rolls (hot rolled) and exits the rolls. Belt casting generally involves delivering molten metal to a pair of endless belts each moving over an entry pulley and an exit pulley. The metal solidifies between the belts during the time that the belt travels from the entry pulleys to the exit pulleys.

Aluminum alloys have successfully been twin roll cast into about ¼ inch thick sheet at about 4–6 feet per minute or about 50–70 pounds per hour per inch of cast width (lbs/hr/in). Attempts to increase the speed of twin roll casting typically fail due to centerline segregation. Although it is generally accepted that reduced gauge sheet (e.g. less than about ¼ inch thick) potentially could be produced more quickly than higher (thicker) gauge sheet in a twin roll caster, the ability to twin roll cast aluminum at rates significantly above about 70 lbs/hr/in has been elusive.

Typical operation of a twin roll caster at thin gauges is described in U.S. Pat. No. 5,518,064 (incorporated herein by reference) and depicted in FIGS. 1 and 2. Molten metal M is supplied via a tip T to a pair of water-cooled twin rolls $R_1$ and $R_2$ rotating in the direction of the arrows $A_1$ and $A_2$, respectively. The centerlines of the rolls $R_1$ and $R_2$ are in a vertical or generally vertical plane L (e.g. up to about 15° from vertical) such that the cast strip S forms in a generally horizontal path. Other versions of this method produce strip in a vertical direction. The width of the cast strip S is determined by the width of the tip T. The plane L passes through a region of minimum clearance between the rolls $R_1$ and $R_2$ referred to as the roll nip N. A solidification region exists between the solid cast strip S and the molten metal M and includes a mixed liquid-solid phase region X. A freeze front F is defined between the region X and the cast strip S as a line of complete solidification.

In conventional roll casting, the heat of the molten metal M is transferred to surfaces $U_1$ and $U_2$ of the rolls $R_1$ and $R_2$ such that the location of the freeze front F is maintained upstream of the nip N. In this manner, the molten metal M solidifies at a thickness greater than the dimension of the nip N. The solid cast strip S is deformed by the rolls $R_1$ and $R_2$ to achieve the final strip thickness. Hot rolling of the solidified strip between the rolls $R_1$ and $R_2$ according to conventional roll casting produces unique properties in the strip characteristic of twin roll cast metal strip. For an aluminum alloy, a central zone through the thickness of the strip becomes enriched in esthetic forming elements (esthetic formers) in the alloy such as Fe, Si, Ni, Zn and the like and depleted in peritectic forming elements (Ti, Cr, V and Zr). This enrichment of esthetic formers (i.e. alloying elements other than Ti, Cr, V and Zr) in the central zone occurs because that portion of the strip S corresponds to a region of the freeze front F where solidification occurs last and is known as "centerline segregation". Extensive centerline segregation in the as-cast strip is a factor that restricts the speed of conventional twin roll casters. The as-cast strip also shows signs of working by the rolls. Grains which form during solidification of the metal upstream of the nip become flattened by the rolls. Therefore, roll cast aluminum includes grains with multiaxial (non-equiaxed) structure.

The roll gap at the nip N may be reduced in order to produce thinner gauge strip S. However, as the roll gap is reduced, the roll separating force generated by the solid metal between the rolls $R_1$ and $R_2$ increases. The amount of roll separating force is affected by the location of the freeze front F in relation to the roll nip N. As the roll gap is reduced, the percentage reduction of the metal sheet is increased, and the roll separating force increases. At some point, the relative positions of the rolls $R_1$ and $R_2$ to achieve the desired roll gap cannot overcome the roll separating force, and the minimum gauge thickness has been reached for that position of the freeze front F.

The roll separating force may be reduced by increasing the speed of the rolls in order to move the freeze front F downstream towards the nip N. When the freeze front F is moved downstream (towards the nip N), the roll gap may be reduced. This movement of the freeze front F decreases the ratio between the thickness of the strip at the initial point of solidification and the roll gap at the nip N, thus decreasing the roll separating force as proportionally less solidified metal is compressed and hot rolled. In this manner, as the position of the freeze front F moves towards the nip N, a proportionally greater amount of metal is solidified and then hot rolled at thinner gauges. According to conventional practice, roll casting of thin gauge strip is accomplished by first roll casting a relatively high gauge strip, decreasing the gauge until a maximum roll separating force is reached, advancing the freeze front to lower the roll separating force (by increasing the roll speed) and further decreasing the gauge until the maximum roll separating force is again reached, and repeating the process of advancing the freeze front and decreasing the gauge in an iterative manner until the desired thin gauge is achieved. For example, a 10 millimeter strip S may be rolled and the thickness may be reduced until the roll separating force becomes excessive (e.g. at 6 millimeters) necessitating a roll speed increase.

This process of increasing the roll speed can only be practiced until the freeze front F reaches a predetermined downstream position. Conventional practice dictates that the freeze front F not progress forward into the roll nip N to ensure that solid strip is rolled at the nip N. It has been generally accepted that rolling of a solid strip at the nip N is needed to prevent failure of the cast metal strip S being hot rolled and to provide sufficient tensile strength in the exiting strip S to withstand the pulling force of a downstream winder, pinch rolls or the like. Consequently, the roll separating force of a conventionally operated twin roll caster in which a solid strip of aluminum alloy is hot rolled at the nip N is on the order of several tons per inch of width. Although some reduction in gauge is possible, operation at such high roll separating forces to ensure deformation of the strip at the nip N makes further reduction of the strip gauge very difficult. The speed of a roll caster is restricted by the need to maintain the freeze front F upstream of the nip N and prevent centerline segregation. Hence, the roll casting speed for aluminum alloys has been relatively low.

Continuous casting of aluminum alloys has been achieved on twin belt casters at rates of about 20–25 feet per minute at about ¾ inch (19 mm) gauge reaching a productivity level of about 1400 pounds per hour per inch of width. An example of conventional belt casting is described in U.S. Pat. No. 4,002,197. In twin belt casting, molten metal is fed into a casting region between a pair of moving belts that each revolve around a pair of pulleys. The metal solidifies as it is carried along between the belts and the heat is liberated from the solidifying metal by cooling the inside surfaces of the belts with rapidly moving films of liquid (e.g. water) traveling along the inside surfaces.

The operating parameters for belt casting are significantly different from those for roll casting. In particular, there is no intentional hot rolling of the strip. Solidification of the metal is completed in a distance of about 12–15 inches (30–38 mm) downstream of the nip for a thickness of ¾ inch. The belts are exposed to high temperatures when contacted by molten metal on one surface and are cooled by water on the other surface. This temperature differential may lead to distortion of the belts. The tension in the belt must be adjusted to account for expansion or contraction of the belt due to temperature fluctuations in order to achieve consistent surface quality of the strip. Casting of aluminum alloys on belt casters has been used to date mainly for products having minimal surface quality requirements, such as products which are subsequently painted.

In part of efforts to improve surface quality of belt cast strip, improved heat transfer from the molten metal to a casting surface has been attempted in certain modified belt casters as described in U.S. Pat. Nos. 5,515,908 and 5,564,491 shown schematically in FIGS. 3 and 4. A belt caster generally includes a pair of endless belts B carried by a pair of upper pulleys U and a corresponding pair of lower pulleys P. The arrangement of the pulleys U and P one above the other defines a molding zone Z bounded by the belts B. The gap between the belts B determines the thickness of the strip S, with the gap being most narrow at the nip N between the entry pulleys along the vertical plane L. Molten metal M fed directly via a trough R and tip T into the nip N is confined between the moving belts B and is solidified as it is carried along. Heat liberated by the solidifying metal is withdrawn through the portions of the belts B which are adjacent to the metal being cast. This heat may be withdrawn by cooling the reverse surfaces of the belts via cooling means C such as nozzles positioned to spray a cooling fluid onto the reverse surfaces of the belts or by employing exit pulleys having circumferential channels containing cooling fluid that contacts the belt reverse surfaces as described in U.S. Pat. No. 6,135,199. In a heat sink belt caster, molten metal is delivered to the belts (the casting surface) upstream of the nip with solidification initiating prior to the nip and continued heat transfer from the metal to the belts downstream of the nip. In this system, molten metal is supplied to the belts along the curve of the upstream rollers so that the metal is substantially solidified by the time it reaches the nip between the upstream rollers. The heat of the molten metal and the cast strip is transferred to the belts within the casting region (including downstream of the nip). The heat is then removed from the belts while the belts are out of contact with either of the molten metal or the cast strip. In this manner, the portions of the belts within the casting region (in contact with the molten metal and cast strip) are not subjected to large variations in temperature as occurs in conventional belt casters. The thickness of the strip is limited at least in part by the heat capacity of the belts between which casting takes place. Production rates of up to 2400 lbs/hr/in for 0.08–0.1 inch (2–2.5 mm) strip have been achieved.

However, problems associated with the belts used in conventional belt casting remain. In particular, dimensional uniformity of the cast strip depends on the stability of (i.e. tension in) the belts. For any belt caster, conventional or heat sink type, contact of hot molten metal with the belts and the heat transfer from the solidifying metal to the belts creates instability in the belts. Under certain conditions, the belts that are in contact with the recently solidified strip can cause the strip edges to peel away.

Accordingly, a need remains for a method of high-speed continuous casting of aluminum alloys which minimizes the contact of belts with solidifying metal yet achieves uniformity in the cast strip surface at high production rates.

SUMMARY OF THE INVENTION

This need is met by a twin belt continuous casting apparatus for casting metal strip having (i) a first endless belt supported and moved on the surfaces of a first entry pulley and a first exit pulley and (ii) a second endless belt supported and moved on the surfaces of a second entry pulley and a second exit pulley, with an entry nip defined between the first and second entry pulleys and an exit nip defined between the first and second exit pulleys. A casting region into which molten metal is supplied is defined between opposing surfaces of the first and second belts moving on the first and second entry pulleys. Opposing surfaces of the first and second belts progressively diverge from each other in the direction of movement thereof. The angle of divergence between the opposing surfaces of the belts may range from about 1° up to about 90° including all numbers and/or fractional values and within this range. In one embodiment, the opposing surface of the second belt is substantially horizontal and the opposing surface of the first belt is at an elevated angle, e.g. ranging from about 1° to about 90° from horizontal or from about 2° to about 90°.

Another embodiment of the invention includes a continuous casting apparatus for casting metal strip having a rotating roll and an entry pulley defining a nip therebetween, an exit pulley spaced apart from the entry pulley, an endless belt supported and moved on a surface of the entry pulley and a surface of the exit pulley, and a casting region into which molten metal is supplied, the casting region being defined between a surface of the roll and an opposing surface of the belt moving on the entry pulley and the exit pulley. The roll may be internally cooled and have a casting surface including surface irregularities In operation, the casting apparatuses of the present invention can produce strip at a rate of over about 25 to about 400 feet per minute or at a rate of over about 100 to about 300 feet per minute. The force applied by the first and second entry pulleys to the metal passing through the entry nip is about 25 to about 700 pounds per inch of width of the strip. The metal cast preferably is non-ferrous, such as an aluminum alloy produced into strip having a thickness of about 0.07 to about 0.25 inch.

BRIEF DESCRIPTION OF THE DRAWINGS

A complete understanding of the invention will be obtained from the following description when taken in connection with the accompanying drawing figures wherein like reference characters identify like parts throughout.

DETAILED DESCRIPTION OF THE INVENTION

For purposes of the description hereinafter, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. When referring to any numerical range of values, such ranges are understood to include each and every number and/or fraction between the stated range minimum and maximum.

The present invention includes a method and apparatus of continuously casting metal using a single casting belt. Many features of the present invention are similar to conventional belt casting. Accordingly, it is contemplated that a conventional belt caster may be modified to practice the present invention.

Figure 1:
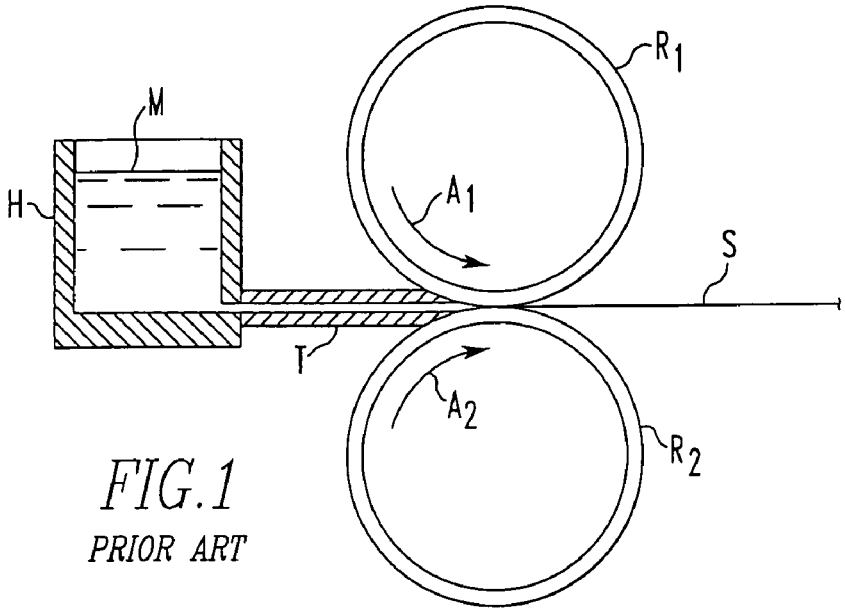
FIG.1 PRIOR ART
FIG. 1 is a schematic of a prior art twin roll caster with a molten metal delivery tip and a pair of rolls.
Figure 2:
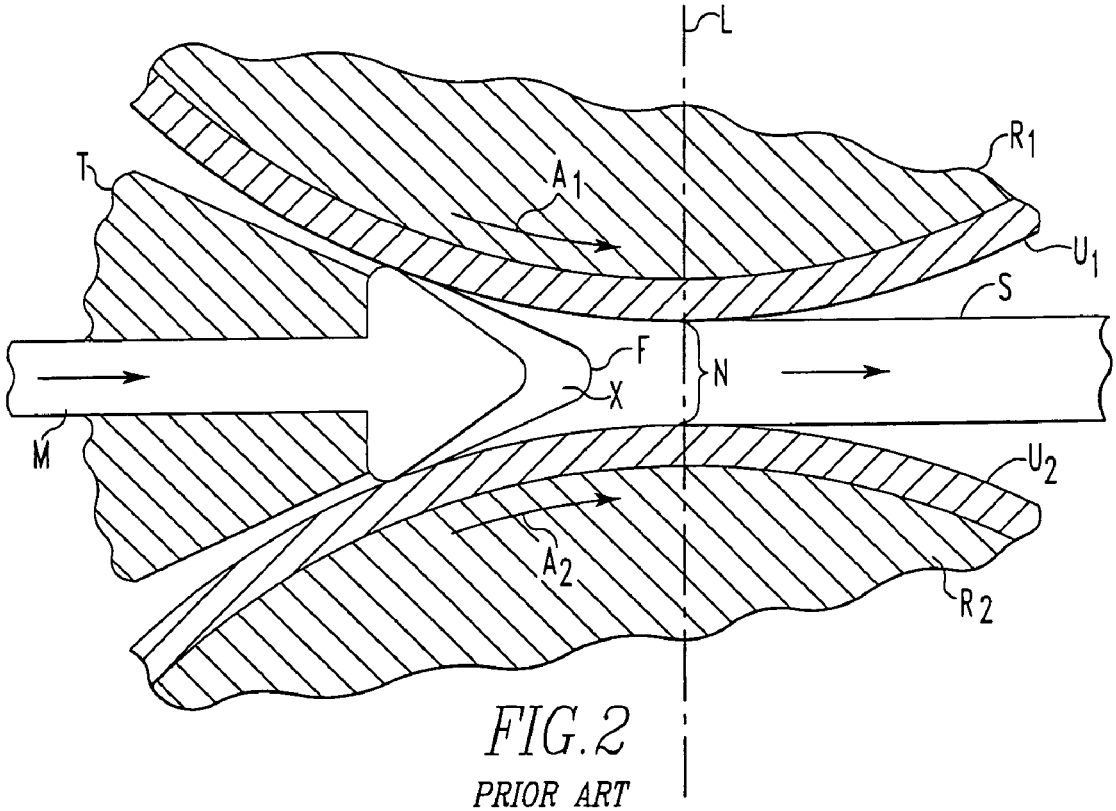
FIG.2 PRIOR ART
FIG. 2 is an enlarged cross-sectional schematic of a portion of the molten metal delivery tip and rolls shown in FIG. 1 operated according to the prior art.
Figure 3:
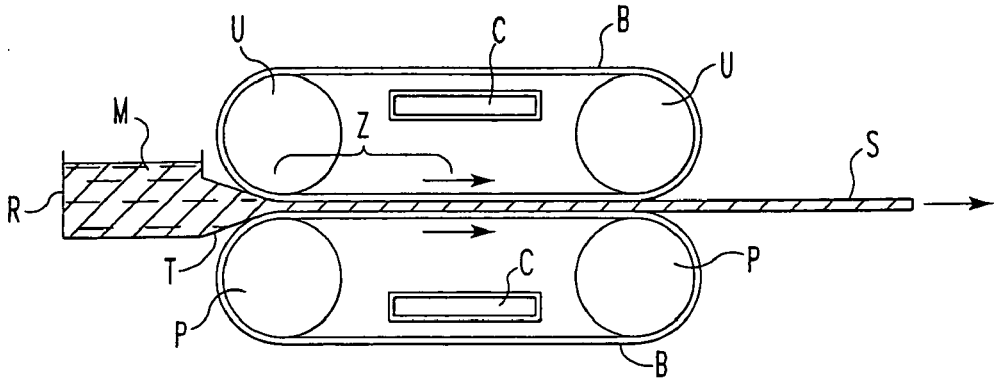
FIG. 3 PRIOR ART
FIG. 3 is a schematic of a prior art heat sink belt caster, with a molten metal delivery tip, a pair of belts and two sets of pulleys.
Figure 5:
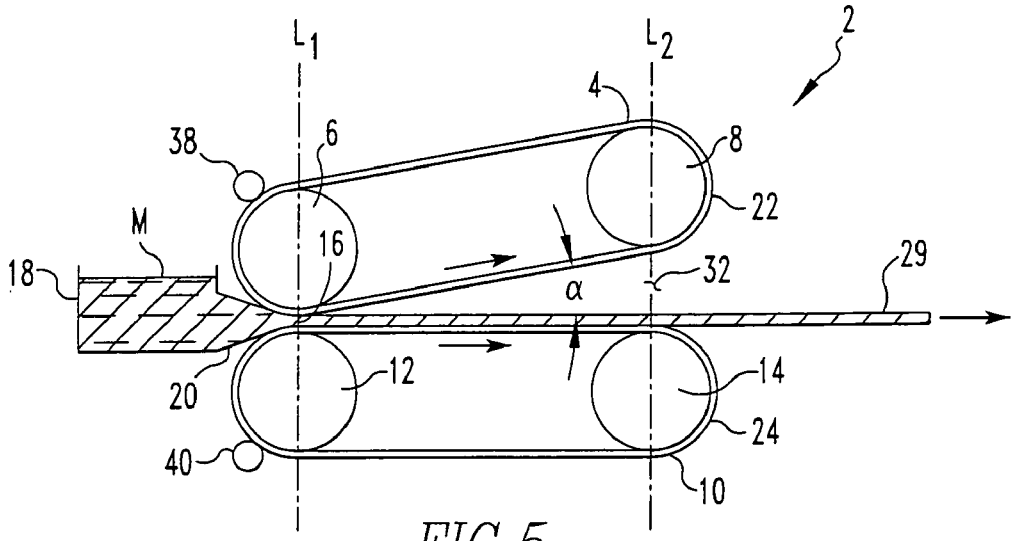
FIG. 5 is a schematic of a continuous caster of the present invention, with a molten metal delivery tip, a pair of diverging belts revolving over two sets of pulleys.
Figure 6:
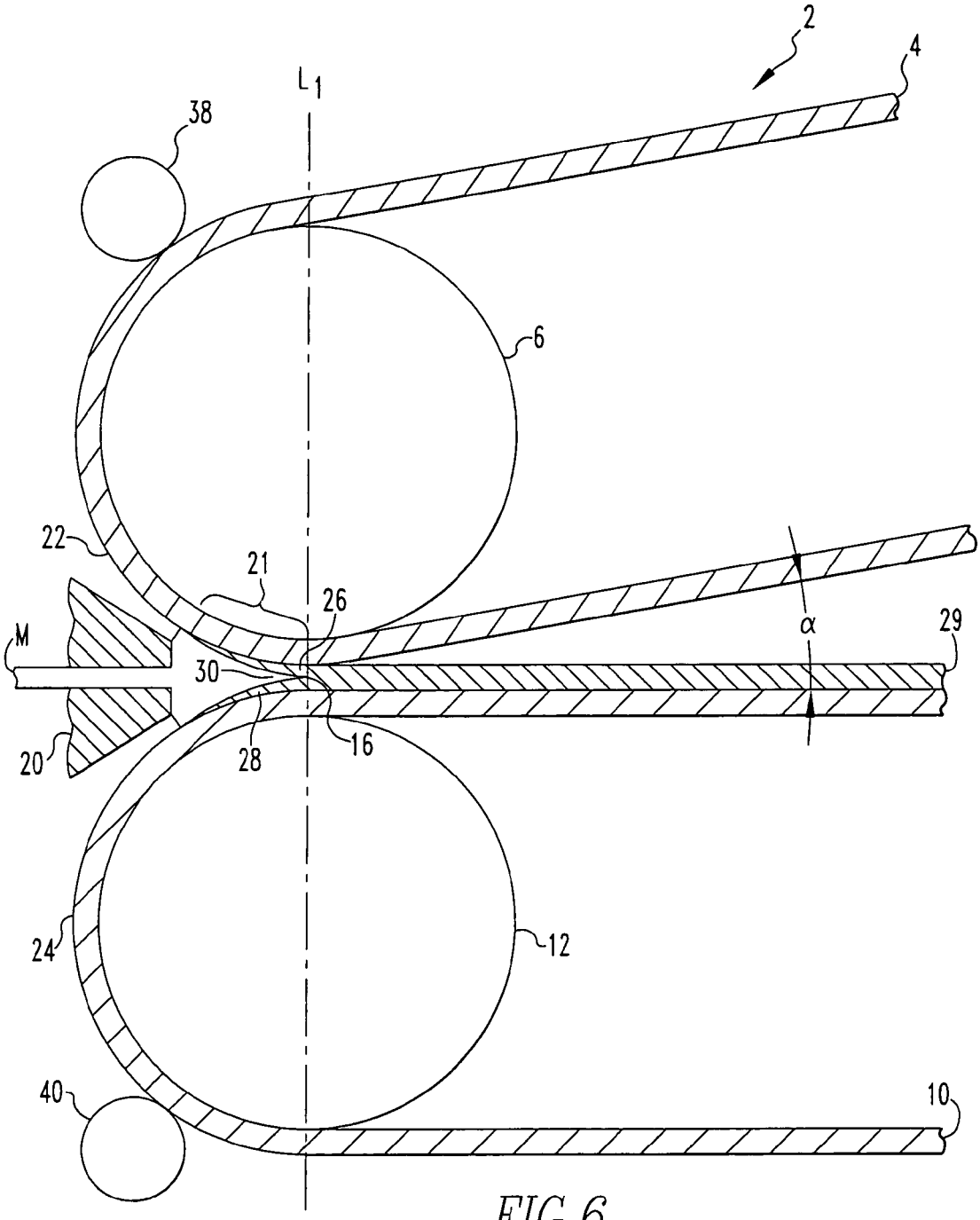
FIG. 6 is an enlarged cross-sectional schematic of a portion of the molten metal delivery tip, belts and entry pulleys shown in FIG. 5 operated according to the present invention.

Referring to FIGS. 5 and 6, one embodiment of the invention includes a casting apparatus 2 having a first endless belt 4 carried by a first entry pulley 6 and a first exit pulley 8 (shown in FIG. 5) and a second endless belt 10 carried by a second entry pulley 12 and a second exit pulley 14 (shown in FIG. 5). Each pulley is mounted for rotation about its longitudinal axis. The pulleys 6, 8, 12, and 14 are of a suitable heat resistant type, and either or both of the upper pulleys 6 and 8 and the lower pulleys 12 and 14 is driven by a suitable motor not illustrated in the drawing for purposes of simplicity. The belts 4 and 10 are endless and are preferably formed of a metal which has low reactivity or is non-reactive with the metal being cast. As illustrated in FIGS. 5 and 6, the entry pulleys 6 and 12 are positioned one above the other. An entry nip 16 is defined between the belts 4 and 10 along a plane $L_1$ passing through the axes of the entry pulleys 6 and 12 which is perpendicular to the belts 4 and 10. Thus, the thickness of the metal strip being cast is determined by the dimension of the entry nip 16 between belts 4 and 10 passing over the entry pulleys 6 and 12.

Molten metal M to be cast is supplied through a suitable metal supply member, such as a tundish 18, in fluid communication with a tip 20 to deliver a horizontal stream of molten metal M to a casting region 21 defined by the tip 20 and the belts 4 and 10 between the entry pulleys 6 and 8. The interior dimensions of the tip 20 generally correspond to the width of the product to be cast. The distance between the tip 20 and each of the belts 4 and 10 is maintained as small as possible to prevent molten metal from leaking out and to minimize the exposure of the molten metal to the atmosphere along the curved portion of the belts 4 and 10 moving over the entry pulleys 6 and 12 yet avoid contact between the tip 20 and the belts 4 and 10. The stream of molten metal M flows from the tip 20 to fill the casting region 21 between the curvature of each belt 4 and 10 to the entry nip 16. The molten metal begins to solidify upon contact with respective opposing surfaces 22 and 24 of the belts 4 and 10 moving over the entry pulleys 6 and 12. A pair of outer solidified layers of metal 26 and 28 forms adjacent to the belts 4 and 10 with a semisolid inner layer 30 therebetween. The semisolid inner layer 30 is solidified at the entry nip 16 and thereby joins with the outer layers 26 and 28 to produce a solid strip 29 exiting the entry nip 16. Supply of the stream of molten metal M to the casting region 21 where the metal M contacts the curved sections of the opposing surfaces 22 and 24 of belts 4 and 10 passing over the entry pulleys 6 and 12 serves to limit distortion and thereby maintain better thermal contact between the molten metal M and each of the opposing surfaces 22 and 24 of the belts as well as improving the quality of the top and bottom surfaces of the cast strip.

Unlike prior belt casters, the first endless belt 4 of the present invention does not remain substantially parallel and adjacent to the cast strip. In other words, the disclosed invention is fully operational even though the first endless belt 4 does not remain parallel to the cast strip. Instead, opposing surfaces 22 and 24 of the belts 4 and 10 progressively diverge from the casting region 21 in the direction of their travel. An exit nip 32, defined between the belts 4 and 10 along a plane $L_2$ passing through the axes of the exit pulleys 8 and 14, has a greater dimension than the entry nip 16. An angle $\alpha$ between the plane of the opposing surface 22 of the first belt 4 and the plane of the opposing surface 24 of the second belt 10 ranges between about 1° and 90°. In this manner, the second belt 10 alone contacts the cast strip 29 after the entry nip 16. In the embodiment shown in FIG. 5, the first exit pulley 8 is positioned higher than the first entry pulley 6 so that the opposing surface 22 of the first belt 4 travels upwardly while the opposing surface 24 of the second belt 10 travels in a substantially horizontal plane. The angle a between the opposing surfaces 22 and 24 can range from about 2° to about 5° from horizontal, or from about 3° to about 5°, or from about 3° to about 45°, or from about 4° to about 45°, or from about 5° to about 45°, or from about 5° to about 90°, or from about 15° to about 20°, or from about 15° to about 90°. This arrangement is not meant to be limiting as other relative positioning of the belts 4 and 10 may be used to accomplish progressive divergence of their opposing surfaces 22 and 24. It will be appreciated that when the angle $\alpha$ is 90° or approaches 90°, the first belt 4 has minimal contact with the solidifying strip. In essence, the casting occurs between the first entry pulley 6 (covered by the first belt 4) and the second entry pulley 12 (covered by the second belt 10). While such an arrangement has some features in common with twin roll casting, one advantage of this arrangement is that the pulleys 6 and 12 are covered by replaceable surfaces (the belts 4 and 10). During casting, bits of solidified metal can build up on the casting surfaces and cause damage thereto. Replacement (or refurbishment) of damaged rolls of a twin roll caster adds significantly to the cost of operating the caster. In contrast, the present invention only requires replacement of worn belts at a fraction of the cost of replacing rolls.

The exit pulleys 8 and 14 may define circumferential channels (not shown) containing cooling fluid that contacts and cools the reverse surfaces of the belts 4 and 10 as described in U.S. Pat. No. 6,135,199, incorporated herein by reference. Alternatively, the casting apparatus 2 may include a pair of cooling members positioned in the return loop of the belts 4 and 10 as described above for the prior art and generally disclosed in U.S. Pat. No. 5,564,491, incorporated herein by reference. Thus, molten metal M flows from the tundish 18 through the tip 20 into the casting region 21 where the belts 4 and 10 are heated by heat transfer from the metal M to the belts 4 and 10. The cast metal strip 29 is conveyed by the second belt 10 until the belt 10 is turned past the centerline of exit pulley 14. Thereafter, the belts 4 and 10 are cooled by the respective exit pulleys 8 and 14 having define circumferential channels containing cooling fluid that contacts and cools the reverse surfaces of the belts 4 and 10 (and/or are cooled by cooling members directed to cooling the reverse surfaces of the belts 4 and 10 in the return loop) to remove substantially all of the heat transferred to the belts 4 and 10 during casting.

The casting apparatus 2 further includes scraping members, shown schematically at 38 and 40, such as scratch brushes which engage the respective belts 4 and 10 to clean any bits of solidified metal or other debris from the surfaces thereof prior to delivery of molten metal M onto the belts 4 and 10. The scraping members 38 and 40 may be positioned at other locations of return loops of the belts 4 and 10.

Figure 7:
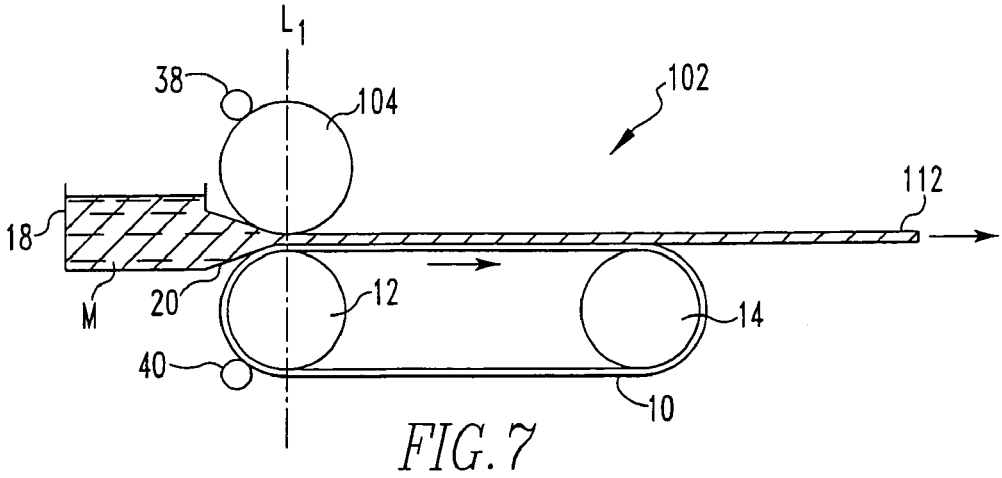
FIG. 7 is a schematic of a continuous caster of the present invention, with a molten metal delivery tip, a single lower belt revolving over a set of pulleys and an upper roll.
Figure 4:
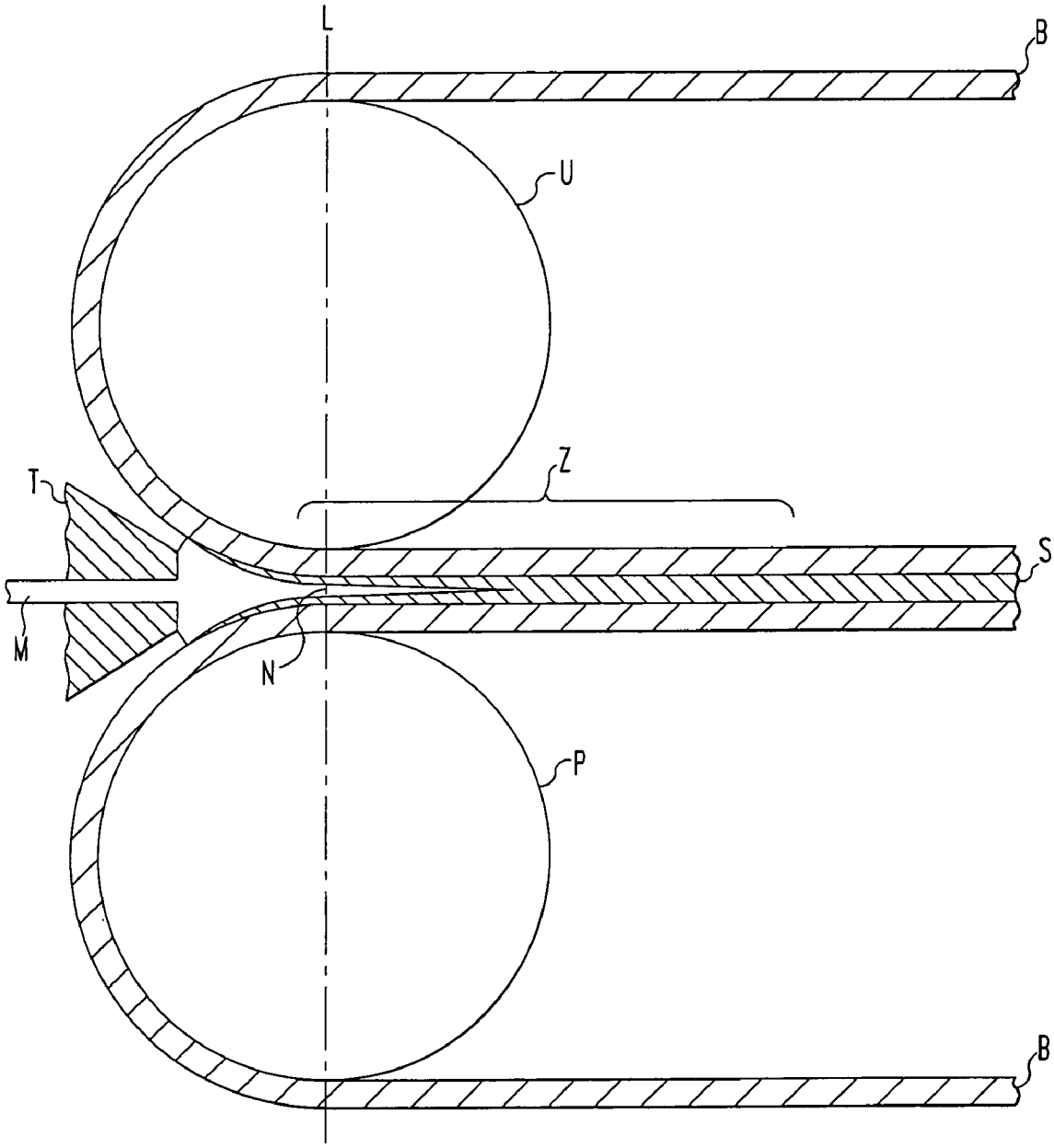
FIG. 4 PRIOR ART
FIG. 4 is an enlarged cross-sectional schematic of a portion of the molten metal delivery tip, belts and pulleys shown in FIG. 3 operated according to the prior art.
Figure 8:
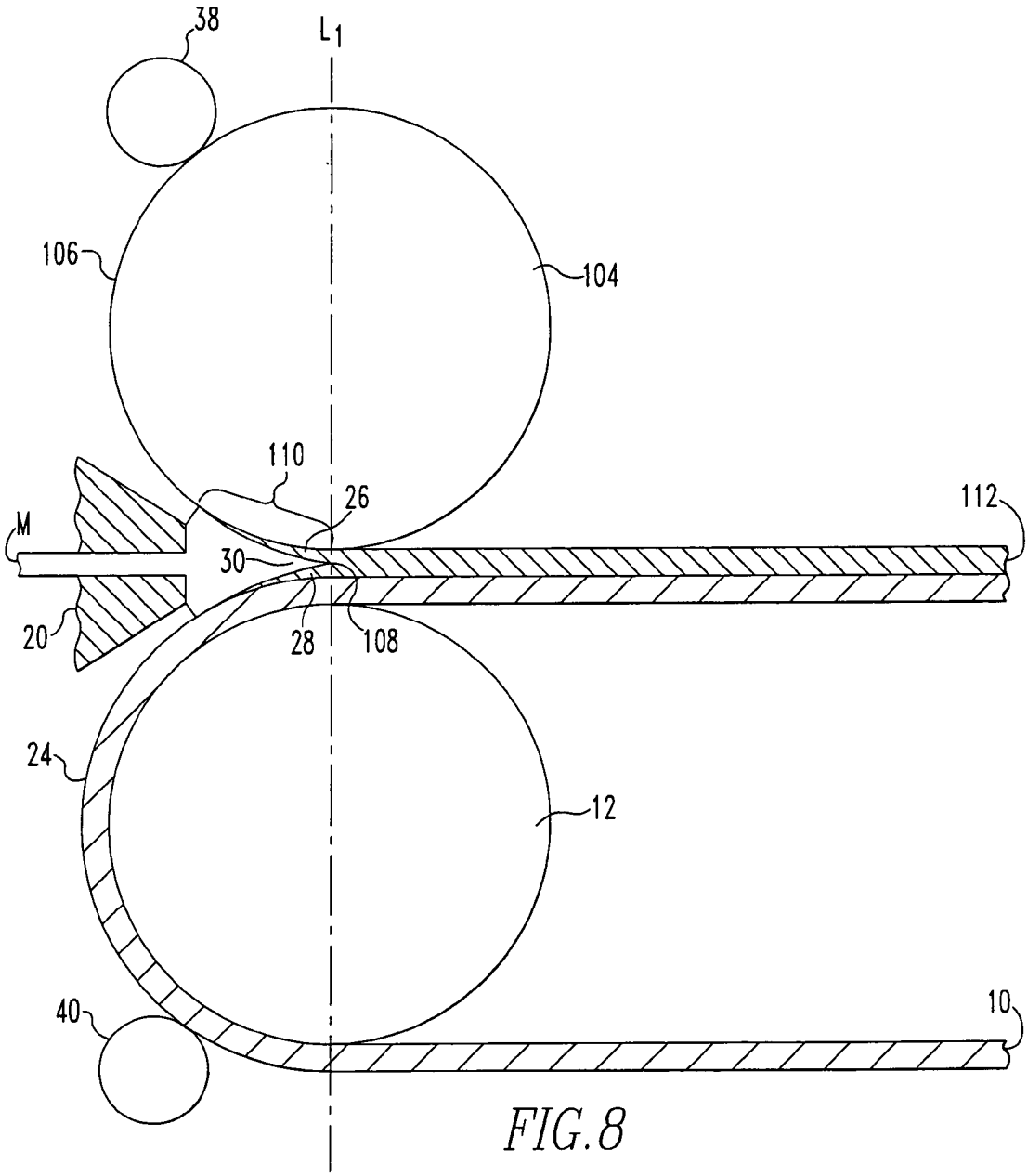
FIG. 8 is an enlarged cross-sectional schematic of a portion of the molten metal delivery tip, belt and roll shown in FIG. 7 operated according to the present invention.

In another embodiment of the invention shown in FIGS. 7 and 8, a single belt is used. The casting apparatus 102 of FIG. 7 may be considered to be a hybrid between a twin roll caster and a belt caster as it includes an upper roll 104 with a casting surface 106 and a lower belt 10 moving over entry and exit pulleys 12 and 14. A nip 108 of minimum clearance is defined between the roll surface 106 and the belt surface 24 along vertical plane $L_1$. While not shown in FIGS. 7 and 8, the upper roll 104 is cooled internally or externally. A casting region 110 of this embodiment is defined by the tip 20, the surface 106 of roll 104 and the surface 24 of the belt 10 moving over the entry pulley 12. The molten metal M is supplied from the tip 20 to the roll surface 106 and the belt surface 24 and begins to solidify upon contact therewith by forming outer solidified layers 26 and 28 adjacent to the roll surface 106 and the belt surface 24, respectively, and semisolid inner layer 30. The semisolid inner layer 30 is solidified at the nip 108 and thereby joins with the outer layers 22 and 24 to produce solid strip 112 exiting the nip 108.

The roll surface 106 may be made from steel, copper or other suitable material and is textured to include surface irregularities (not shown) which contact the molten metal M. The surface irregularities may serve to improve the heat transfer from the surfaces 106. A controlled degree of nonuniformity in the surface 106 results in uniform heat transfer across the surface 106. The surface irregularities may be in the form of grooves, dimples, knurls or other structures and may be spaced apart in a regular pattern of about 20 to about 120 surface irregularities per inch or about 60 irregularities per inch. The surface irregularities may have a height of about 5 to about 50 microns or about 30 microns. The roll 104 may be coated with a material to enhance separation of the cast strip 112 from the roll 104, such as chromium or nickel. The roll surface 106 heats up during casting and is prone to oxidation at elevated temperatures. Nonuniform oxidation of the roll surface 106 during casting can change the heat transfer properties of the roll 104. Hence, the roll surface 106 may be oxidized prior to use to minimize changes thereof during casting. It may be beneficial to brush the roll surface 106 from time to time or continuously to remove debris which builds up during casting of aluminum and aluminum alloys. Small pieces of the cast strip 112 may break free from the strip 112 and adhere to the roll surface 106. These small pieces of strip are prone to oxidation, which result in nonuniformity in the heat transfer properties of the roll surface 106. Brushing of the roll surface 106 avoids the nonuniformity problems from debris which may collect on the roll surface 106.

In both embodiments, the control, maintenance, and selection of the appropriate speed of the pulleys, roll, and speed of the belts may impact the operability of the present invention. The speed of the belts (or belt speed with roll speed) determines the speed that the molten metal M advances towards the entry nip 16 (or nip 108). The present invention is suited for operation at high speeds such as about 25 to about 400 feet per minute, or about 100 to about 400 feet per minute, or about 150 to about 300 feet per minute, or about 200 to about 400 feet per minute, or about 225 to about 400 feet per minute, or about 300 to about 400 feet per minute.

The separating force between the entry pulleys 6 and 8 and between the roll 104 and exit pulley 8 may be a parameter in practicing the present invention. A significant benefit of the present invention is that solid strip is not produced until the metal reaches the nip 16 or 108 (FIG. 6 or 8, respectively). The thickness is determined by the dimension of the nip 16 or 108. The roll separating force may be sufficiently great to squeeze molten metal upstream and away from the nip 16 or 108. Excessive molten metal passing through the nip 16 or 108 may cause the outer solidifying layers 26, 28 and the inner layer 30 to fall away from each other and become misaligned. Insufficient molten metal reaching the nip 16 or 108 causes the strip to form prematurely as occurs in conventional roll casting processes. A prematurely formed strip may be deformed by the entry pulleys and experience centerline segregation. Suitable separating forces are about 25 to about 700 pounds per inch of width cast or about 100 to about 300 pounds per inch of width cast. In general, slower casting speeds may be needed when casting thicker gauge metal in order to remove the heat from the thick metal. Unlike conventional roll casting, such slower casting speeds do not result in excessive separating forces in the present invention because fully solid metal strip is not produced upstream of the nip 16 or 108.

Thin gauge metal strip product may be cast according to the method of the present invention. Roll separating force has been a limiting factor in producing low gauge metal strip product in twin roll casters but the present invention is not so limited because the separating forces are as much as 1000 times less than in conventional processes. Metal strip may be produced as thin as about 0.07 inch at casting speeds of 25 to about 400 feet per minute or about 100 to about 300 feet per minute. Thicker gauge metal strip may also be produced using the method of the present invention, for example at a thickness of about ¼ inch.

It is contemplated that conventional roll casters or belt casters may be retrofitted for operation according to the present invention. The gearbox and associated components of a conventional caster typically cannot accommodate the high speeds contemplated according to the present invention. Hence, these driving components may need to be upgraded in order to practice the present invention. In addition, upgrades to the devices used for cooling the belts may also be needed to compensate for the higher casting rates. A combination of fixed dams and electromagnetic edge dams may be included on a continuous caster operated according to the inventive method. Further, the strip may be cooled and supported at the exit to avoid hot shortness and may be subsequently hot rolled before coiling.

Continuous casting of metal according to the present invention is achieved by initially selecting the desired dimension of the entry nip corresponding to the desired gauge of the strip. Casting at the rates contemplated by the present invention (i.e. about 25 to about 400 feet per minute) solidifies the metal strip about 1000 times faster than metal cast as an ingot and improves the properties of the strip over metals cast as an ingot.

Suitable metal alloys for use in practicing the present invention include non-ferrous metal alloys such as alloys of aluminum and alloys of magnesium. Aluminum Association alloys of the 1xxx, 3xxx, 5xxx, 6xxx and 8xxx series have been successfully continuously cast using the first embodiment of the invention.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. In a twin belt continuous casting apparatus for casting metal strip, the apparatus comprising (i) a first endless belt supported and moved on the surfaces of a first entry pulley and a first exit pulley and (ii) a second endless belt supported and moved on the surfaces of a second entry pulley and a second exit pulley, with an entry nip defined between the first and second entry pulleys and an exit nip defined between the first and second exit pulleys, the invention comprising:

a casting region into which molten metal is supplied, the casting region being defined between opposing surfaces of the first and second belts moving on the first and second entry pulleys, wherein opposing surfaces of the first and second belts progressively diverge from each other in the direction of movement thereof.

2. The apparatus of claim 1 wherein an angle that the opposing surface of the first belt makes with the opposing surface of the second belt is about 1° to about 90°.

3. The apparatus of claim 2 wherein said angle is about 2° to about 90°.

4. The apparatus of claim 3 wherein said angle is about 2° to about 45°.

5. The apparatus of claim 1 wherein the opposing surface of the second belt is substantially horizontal and the opposing surface of the first belt is at an elevated angle.

6. The apparatus of claim 1 further comprising a pair of scraping members positioned adjacent to the portion of first and second belts moving over the first and second entry pulleys for removing debris from the first and second belts.

7. In a method of continuously casting metal by continuous belt casting comprising (i) moving a first endless belt around a first entry pulley arid a first exit pulley, (ii) moving a second endless belt around a second entry pulley and a second exit pulley, with an entry nip defined between the first and second entry pulleys and an exit nip defined between the first and second exit pulleys, (iii) supplying molten metal to the surfaces of the belts moving over the first and second entry pulleys whereby the metal solidifies in a strip, the invention comprising:

supplying molten metal into a casting region, the casting region being defined between opposing surfaces of the first and second belts moving on the first and second entry pulleys; and progressively diverging opposing surfaces of the first and second belts from each other in the direction of movement thereof.

8. The method of claim 7 wherein an angle that the opposing surface of the first belt makes with the opposing surface of the second bolt is about 1° to about 90°.

9. The method of claim 8 wherein said angle is about 2° to about 90°.

10. The method of claim 9 wherein said angle is about 2° to about 45°.

11. The method of claim 7 wherein the opposing surface of the second belt is substantially horizontal and the opposing surface of the first belt is at an elevated angle.

12. The method of claim 7 further comprising removing debris from the first and second belts.

13. The method of claim 7 wherein the strip of metal exits the entry nip at a rate of over about 25 to about 400 feet per minute.

14. The method of claim 7 wherein the strip of metal exits the entry nip at a rate of about 100 to about 300 feet per minute.

15. The method of claim 7 wherein the force applied by the first and second entry pulleys to the metal passing through the entry nip is about 25 to about 700 pounds per inch of width of the strip.

16. The method of claim 15 wherein the metal is non-ferrous.

17. The method of claim 16 wherein the metal is a aluminum alloy.

18. The method of claim 7 wherein the solid strip has a thickness of about 0.07 to about 0.25 inch.

* * * * *